US007267290B2

(12) United States Patent
Gopalan et al.

(10) Patent No.: US 7,267,290 B2
(45) Date of Patent: Sep. 11, 2007

(54) COLD-PERFORMANCE FLUIDIC OSCILLATOR

(75) Inventors: Shridhar Gopalan, Westminster, MD (US); Gregory Russell, Baltimore, MD (US)

(73) Assignee: Bowles Fluidics Corporation, Columbia, MD (US)

( * ) Notice: Subject to any disclaimer, the term of this patent is extended or adjusted under 35 U.S.C. 154(b) by 0 days.

(21) Appl. No.: 10/979,032

(22) Filed: Nov. 1, 2004

(65) Prior Publication Data

US 2006/0091242 A1 May 4, 2006

(51) Int. Cl.
*B05B 1/08* (2006.01)
*B05B 17/04* (2006.01)
*F15C 1/08* (2006.01)

(52) U.S. Cl. ..... 239/589.1; 239/11; 239/101; 239/DIG. 3; 137/826

(58) Field of Classification Search ..... 239/589.1, 239/11, 101, DIG. 3, 284.2, 502, DIG. 7; 137/826, 825, 599.01
See application file for complete search history.

(56) References Cited

U.S. PATENT DOCUMENTS

| | | | | |
|---|---|---|---|---|
| 3,185,166 | A | 5/1965 | Horton | 137/81.5 |
| 3,563,462 | A | 2/1971 | Bauer | 239/456 |
| 4,052,002 | A | 10/1977 | Stouffer | 239/4 |
| 4,151,955 | A | 5/1979 | Stouffer | 239/11 |
| 4,157,161 | A | 6/1979 | Bauer | 239/11 |
| 4,231,519 | A | 11/1980 | Bauer | 239/4 |
| 4,398,664 | A | 8/1983 | Stouffer | 239/11 |
| 4,463,904 | A | 8/1984 | Bray | 239/284 |
| 4,508,267 | A | 4/1985 | Stouffer | 239/11 |
| 4,562,867 | A | 1/1986 | Stouffer | 137/811 |
| 5,035,361 | A | 7/1991 | Stouffer | 239/589.1 |
| 5,181,660 | A | 1/1993 | Stouffer et al. | 239/589.1 |
| 5,213,269 | A | 5/1993 | Srinath et al. | 239/589.1 |
| 5,749,525 | A | 5/1998 | Stouffer | 239/284.1 |
| 5,820,034 | A | 10/1998 | Hess | 239/589.1 |
| 5,845,845 | A | 12/1998 | Merke et al. | 239/1 |
| 5,906,317 | A | 5/1999 | Srinath | 239/284.1 |
| 5,971,301 | A | 10/1999 | Stouffer et al. | 239/589.1 |
| 6,186,409 | B1 | 2/2001 | Srinath et al. | 239/1 |
| 6,240,945 | B1 | 6/2001 | Srinath et al. | 137/14 |
| 6,253,782 | B1 | 7/2001 | Raghu | 137/14 |
| 6,457,658 | B2 * | 10/2002 | Srinath et al. | 239/589.1 |
| 6,805,164 | B2 | 10/2004 | Stouffer | |

* cited by examiner

*Primary Examiner*—Kevin Shaver
*Assistant Examiner*—Darren Gorman
(74) *Attorney, Agent, or Firm*—Larry J. Guffey

(57) ABSTRACT

A fluidic oscillator suitable for use at colder temperatures for generating an exhaust flow in the form of an oscillating spray of fluid droplets has an inlet for pressurized fluid, a pair of power nozzles configured to accelerate the movement of the pressurized fluid, a fluid pathway that connects and allows for the flow of pressurized fluid between its inlet and the power nozzles, an interaction chamber which is attached to the nozzles and receives the flow from the nozzles, a fluid outlet from which the spray exhausts from the interaction chamber, and a means for increasing the instability of the flow from the power nozzles, with this means being situated in a location chosen from the group consisting of a location within the fluid pathway or proximate the power nozzles. In a first preferred embodiment, the flow instability generating means comprises a protrusion that extends inward from each side of the fluid pathway so as to cause a flow separation region downstream of the protrusions. In a second preferred embodiment, the flow instability generating means comprises a step in the height elevation of the floor of the power nozzles with respect to that of the interaction chamber.

30 Claims, 8 Drawing Sheets

COLD-PERFORMANCE FLUIDIC OSCILLATOR

BACKGROUND OF THE INVENTION

1. Field of the Invention

This invention relates to fluid handling processes and apparatus. More particularly, this invention relates to a fluidic oscillator that can operate at the colder temperatures usually associated with higher viscosity fluids.

2. Description of the Related Art

Fluidic oscillators are well known in the prior art for their ability to provide a wide range of liquid spray patterns by cyclically deflecting a liquid jet. The operation of most fluidic oscillators is characterized by the cyclic deflection of a fluid jet without the use of mechanical moving parts. Consequently, an advantage of fluidic oscillators is that they are not subject to the wear and tear which adversely affects the reliability and operation of other spray devices.

Examples of fluidic oscillators may be found in many patents, including U.S. Pat. Nos. 3,185,166 (Horton & Bowles), 3,563,462 (Bauer), 4,052,002 (Stouffer & Bray), 4,151,955 (Stouffer), 4,157,161 (Bauer), 4,231,519 (Stouffer), which was reissued as RE 33,158, 4,508,267 (Stouffer), 5,035,361 (Stouffer), 5,213,269 (Srinath), 5,971,301 (Stouffer), 6,186,409 (Srinath) and 6,253,782 (Raghu).

A simplification of the nature of the typical oscillations in the flow of a liquid exhausting from such devices into a gaseous environment is shown in FIGS. 1A-1C. For this assumed two-dimensional flow, the alternating formation of vortices in the oscillator's interaction chamber is seen to cause the flow from its outlet at a particular instant to be alternately swept downward (FIG. 1A) or upward (FIG. 1B) such the oscillator's output is spread over a fan angle of approximately 2θ (FIG. 1C).

This type of oscillating liquid jet can yield a variety of patterns for the downstream distribution of the liquid droplets that are formed as this liquid jet breaks apart in the surrounding gaseous environment. One such possible distribution pattern is shown in FIG. 1C.

For the spraying of some high viscosity liquids (i.e., 15-20 centipoise), the "mushroom oscillator" disclosed in U.S. Pat. No. 6,253,782 and shown in FIG. 2 has been found to be especially useful. However, it also has been found that, as the temperature of such liquids continues to decrease so as to cause their viscosity to increase (e.g., 25 centipoise), the performance of this type of oscillator can deteriorate to the point where it no longer provides a jet that is sufficiently oscillatory in nature to allow its spray to be distributed over an appreciable fan angle. This situation is especially problematic in windshield washer applications that utilize such fluidic oscillators.

Despite much prior art relating to fluidic oscillators, there still exists a need for further technological improvements in the design of fluidic oscillators for use in colder environments.

3. Objects and Advantages

There has been summarized above, rather broadly, the prior art that is related to the present invention in order that the context of the present invention may be better understood and appreciated. In this regard, it is instructive to also consider the objects and advantages of the present invention.

It is an object of the present invention to provide new, improved fluidic oscillators and fluid flow methods that are capable of generating oscillating, fluid jets with spatially uniform droplet distributions over a wide range of operating temperatures.

It is another object of the present invention to provide improved fluidic oscillators and fluid flow methods that are capable of generating oscillating, fluid jets with high viscosity liquids.

It is yet another object of the present invention to provide improved fluidic oscillators and fluid flow methods that yield fluid jets and sprays of droplets having properties that make them more efficient for surface cleaning applications.

These and other objects and advantages of the present invention will become readily apparent as the invention is better understood by reference to the accompanying summary, drawings and the detailed description that follows.

SUMMARY OF THE INVENTION

Recognizing the need for the development of improved fluidic oscillators that are capable of operating with liquids at lower temperatures, the present invention is generally directed to satisfying the needs set forth above and overcoming the disadvantages identified with prior art devices and methods.

In accordance with the present invention, the foregoing need can be satisfied by providing a fluidic oscillator that is comprised of the following elements: (a) an inlet for pressurized fluid, (b) a pair of power nozzles configured to accelerate the movement of the pressurized fluid, (c) a fluid pathway that connects and allows for the flow of the pressurized fluid between its inlet and the power nozzles, (d) an interaction chamber which is attached to the nozzles and receives the flow from the nozzles, (e) a fluid outlet from which the fluid exhausts from the interaction chamber, and (f) a means for increasing the instability of the flow from the power nozzles, with this means being situated in a location chosen from the group consisting of a location within the fluid pathway or proximate the power nozzles.

In a first preferred embodiment, the flow instability generating means comprises a protrusion that extends inward from each side of the fluid pathway so as to cause a flow separation region downstream of the protrusions.

In a second preferred embodiment, the flow instability generating means comprises a step in the height elevation of the floor of the power nozzles with respect to that of the adjoining interaction chamber.

Thus, there has been summarized above, rather broadly, the present invention in order that the detailed description that follows may be better understood and appreciated. There are, of course, additional features of the invention that will be described hereinafter and which will form the subject matter of any eventual claims to this invention.

DESCRIPTION OF THE PREFERRED EMBODIMENT

Figure 1A:
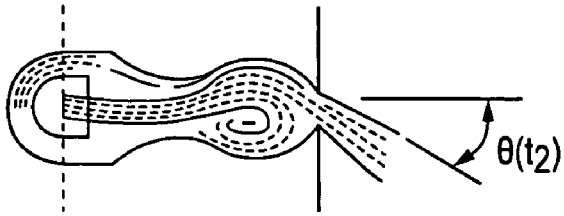
FIGS. 1A-1C illustrate the nature of the typical oscillations in the two-dimensional flow of a liquid exhausting from a fluidic oscillator into a gaseous environment and how the droplets of the spray from such an oscillator are swept over a fan angle of 2θ.
Figure 1B:
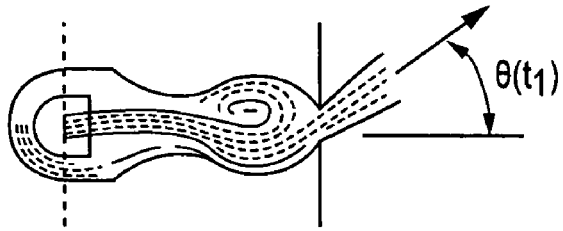
Figure 1C:
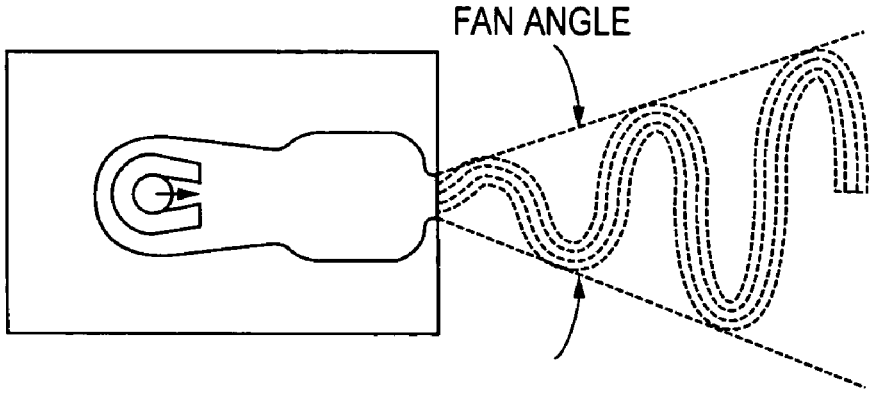

Before explaining at least one embodiment of the present invention in detail, it is to be understood that the invention is not limited in its application to the details of construction and to the arrangements of the components set forth in the following description or illustrated in the drawings. The invention is capable of other embodiments and of being practiced and carried out in various ways.

Also, it is to be understood that the phraseology and terminology employed herein are for the purpose of description and should not be regarded as limiting. For example, the discussion herein below generally relates to liquid spray techniques; however, it should be apparent that the inventive concepts described herein are applicable also to the dispersal of other fluids, including gases, fluidized solid particles, etc.

Figure 3:
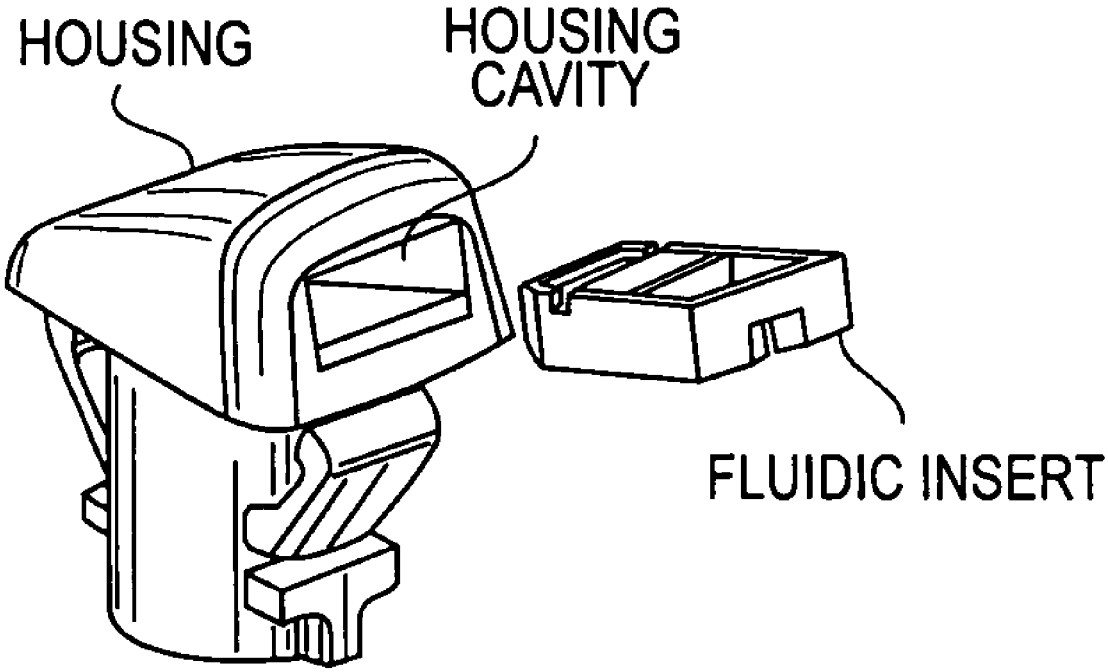
FIG. 3 PRIOR ART
FIG. 3 shows an example of a typical fluidic spray device that is mounted in an automobile's hood to spray the front windshield and into which is inserted a fluidic insert that has molded into its top surface a fluidic circuit similar to that of the invention disclosed herein.

The present invention involves methods for creating fluidic oscillators of the type that are suitable for generating oscillating, fluid jets having very distinctive and controllable flow patterns over a wide range of operating conditions, such as those that are encountered in various automotive windshield, headlamp and rear windshield cleaning applications, as well as various consumer product applications (e.g., hand-held, trigger sprayers). FIG. 3 shows an example of a typical fluidic spray device that is mounted in an automobile's hood to spray the front windshield. This fluidic spray device consists of an automotive housing which has an especially configured cavity into which a fluidic insert 1 is fitted.

Pressurized liquid enters the bottom of this housing and flows upward into an entry orifice in the upstream end of the fluidic insert 1. The liquid then flows through a carefully contoured path or fluidic circuit that has been molded into the top surface of the insert 1.

Figure 2:
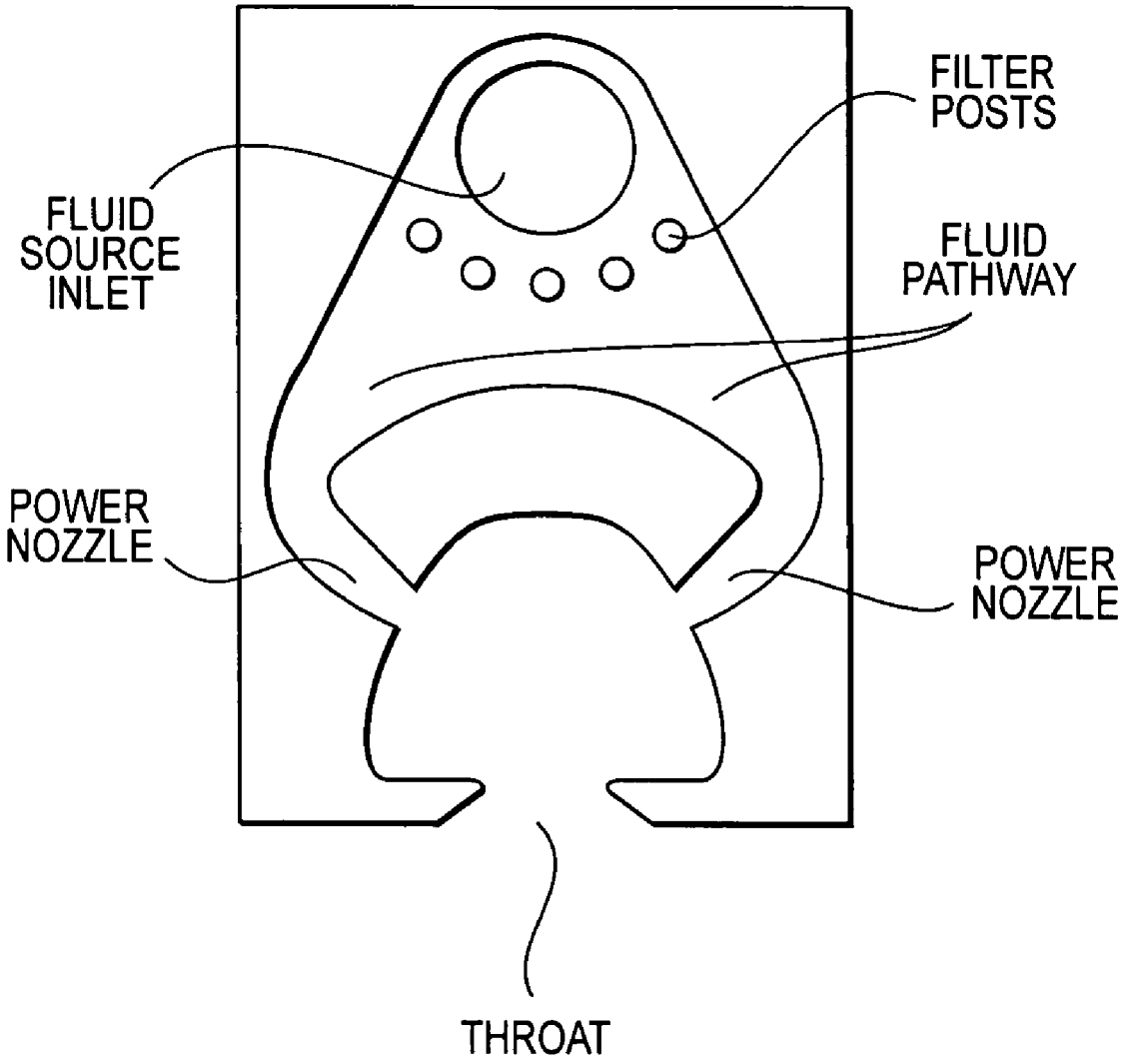
FIG. 2 PRIOR ART
FIG. 2, as disclosed in U.S. Pat. No. 6,253,782, shows a prior art "mushroom oscillator" having an interaction region into which enters the jets from a pair of power nozzles; these jets interact to form interacting vortices which yield an oscillating flow from the fluidic's throat.

There are many well known designs of fluidic circuits or fluidic oscillators 2 that are suitable for use with these fluidic inserts 1. Many of these have some common features, including: (a) at least one power nozzle configured to accelerate the movement of the fluid that flows under pressure through the insert so that the flow from such a power nozzle takes the form of an essentially free jet that separates from, and therefore is not attached to, either of the downstream sidewalls that abut the power nozzle on either of its downstream edges, see FIGS. 5, 6A, 6B and FIGS. 2A-2C of the previously referenced U.S. Pat. No. 6.253.782, (b) an interaction chamber through which the fluid flows and in which the fluid flow phenomena is initiated that will eventually lead to the flow from the insert being of an oscillating nature, (c) a fluid source inlet, (d) a fluid pathway that connects the fluid source inlet and the power nozzle/s, (e) a fluid outlet or throat from which the fluid exits the insert, and (e) filter posts located in the fluid pathway and which serve to filter any larger diameter debris particles that are contained in the fluid flowing through the insert before these particles clog either the downstream power nozzles or the circuit's outlet. See FIG. 2.

As previously mentioned, it is desirable to have a fluidic oscillator that can operate with higher viscosity liquids. To satisfy this need, we have invented the fluidic circuits shown in FIGS. 4, 7 and 11.

Figure 4:
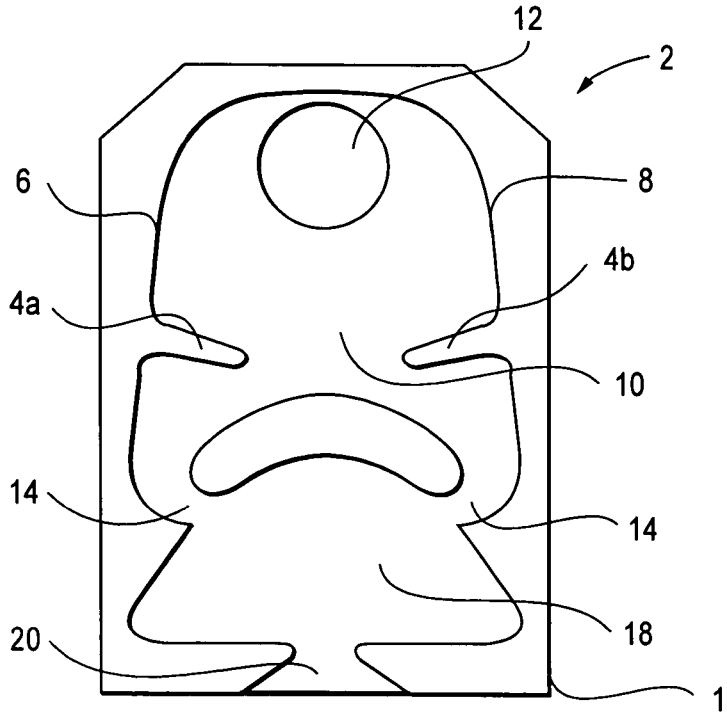
FIG. 4 shows a first embodiment of the present invention in the form of an improved fluidic circuit or oscillator for use with higher viscosity fluids.

The first embodiment of the present invention in the form of a new fluidic circuit or oscillator 2 for use with higher viscosity fluids is shown in its top view in FIG. 4. It is an improvement of the "mushroom oscillator" shown in FIG. 2. The improvement consists of a protrusion 4*a*, 4*b* that extends inward from each sidewall 6, 8 of the fluid pathway 10 that connects the fluid source inlet 12 and the power nozzles 14. These nozzles feed into an interaction chamber 18 from which there is a throat or outlet 20 for the fluid to exhaust from the oscillator 2.

Figure 5:
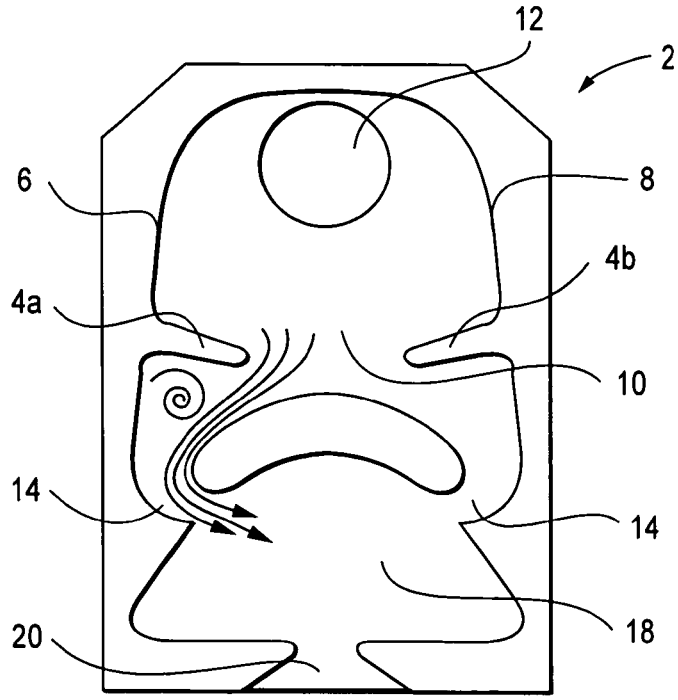
FIG. 5 shows the nature of the flow in the left-hand portion of the fluidic circuit shown in FIG. 4.
Figure 6A:
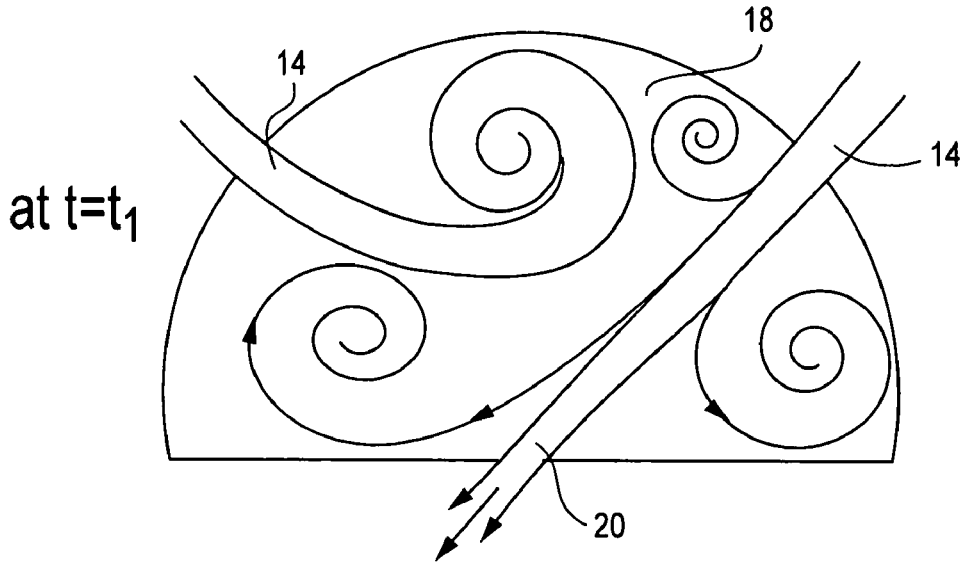
FIGS. 6A-6B illustrate the nature of the flow through an interaction chamber similar to that shown in FIG. 4 at the two instances, $t_1$ and $t_1+\Delta t$.
Figure 6B:
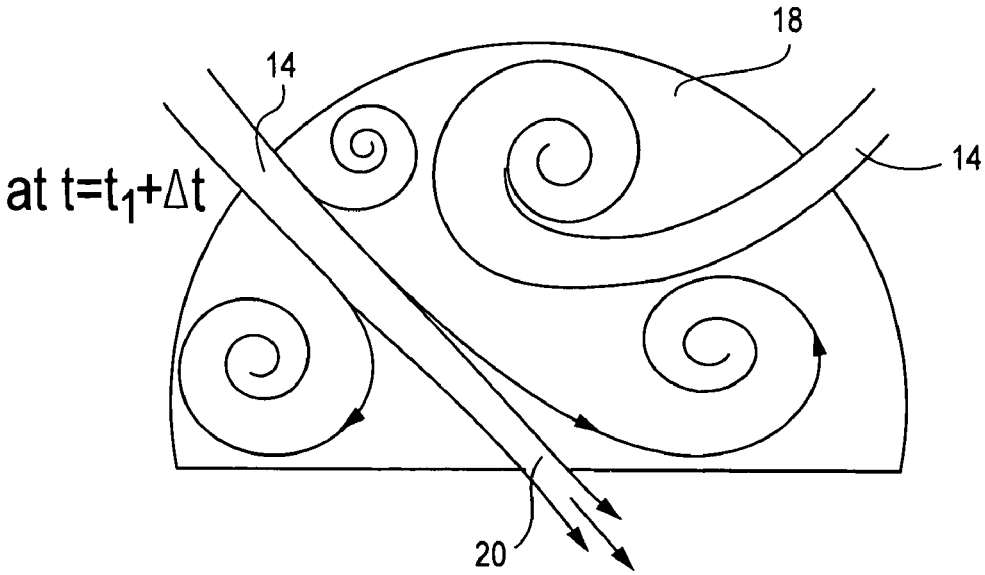

The nature of the flow in the left-hand portion of this circuit is communicated by the flow streamlines which are shown in FIG. 5. The degree to which the protrusions extend from the sidewalls are chosen so as to promote the establishment of a flow separation region behind the protrusions. For example, in a fluidic circuit which is operating at a fluid pressure of approximately 9-15 psig and scaled such that it has power nozzles whose width at its exit is approximately 0.37 mm, a protrusion of length 1.7-1.8 mm extending from the sidewall is seen to give the desired degree of flow separation. Ratios of protrusion lengths to power nozzle widths in the range of 2-6 have been found to be effective at various operating pressures. As a result of this separation phenomenon, a confined vortex is seen to be formed behind each of the protrusions.

These vortices serve to induce fluctuations in the flows that are entering the power nozzles which results in greater instability of the jets that issue from the power nozzles into the interaction chamber. These instabilities are seen to promote significantly greater oscillatory interactions in the jets that flow into the interaction chamber. These interactions cause the flow from the oscillator's throat to be swept from one side to the next thereby yielding the desired large fan angle for the flow from this oscillator. See FIGS. 6A-6B which show the streamlines for the flow through a representative interaction chamber at those two instances, $t_1$ and $t_1+\Delta t$, which reflect the flow conditions where the throat's exhausting flow has been swept to either extreme of its fan angle.

In general, it has been found that such protrusions are most effective for promoting continued oscillatory flow at lower temperatures when the length to which they extend into the fluid pathway is on the order of four to five times the width of the power nozzle at its exit.

It can be noted that such protrusions need not be situated only on the sidewalls. For example, they could conceivably be placed on the floor or ceiling of these pathways as long as they are symmetrically situated with respect to the power nozzles on either side of the fluidic circuit.

Figure 7:
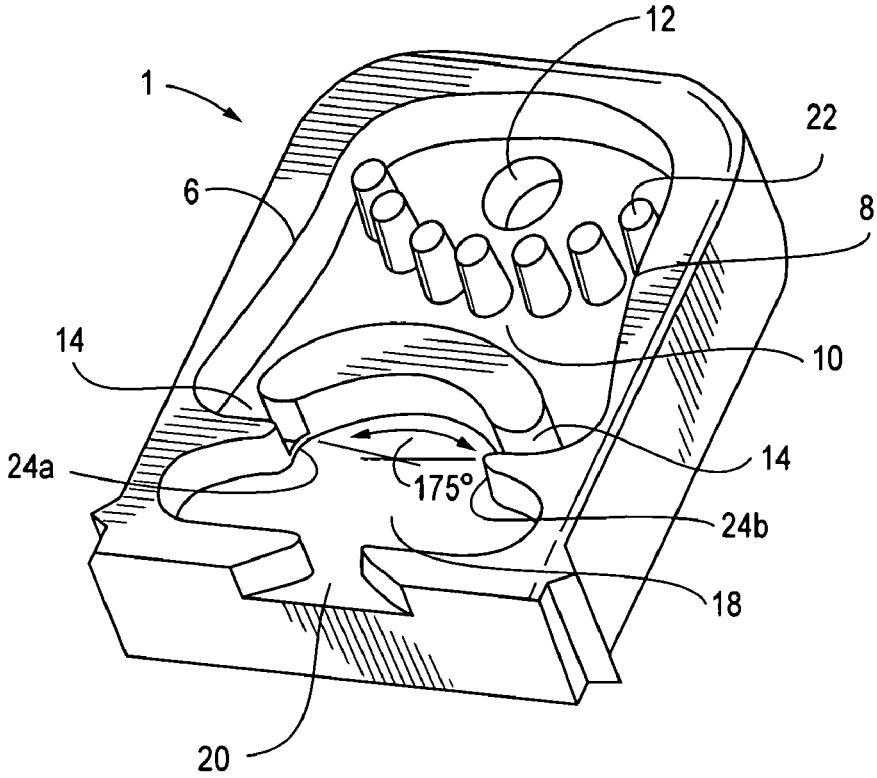
FIG. 7 shows a second embodiment of the present invention in the form of a second, improved fluidic circuit or oscillator for use with higher viscosity fluids.

A second means for introducing instabilities into the flow of the jets that issue from the power nozzles into the interaction chamber is shown in the fluidic insert 1 illustrated in FIG. 7. The fluidic circuit 2 that is inscribed in the top surface of this insert 1 is again a modification of the standard "mushroom oscillator" circuit, except that in this embodiment, the circuit also has filter posts 22 located in the fluid pathway. These posts serve to capture any debris in the fluid before it is able to clog the power nozzles.

Figure 8:
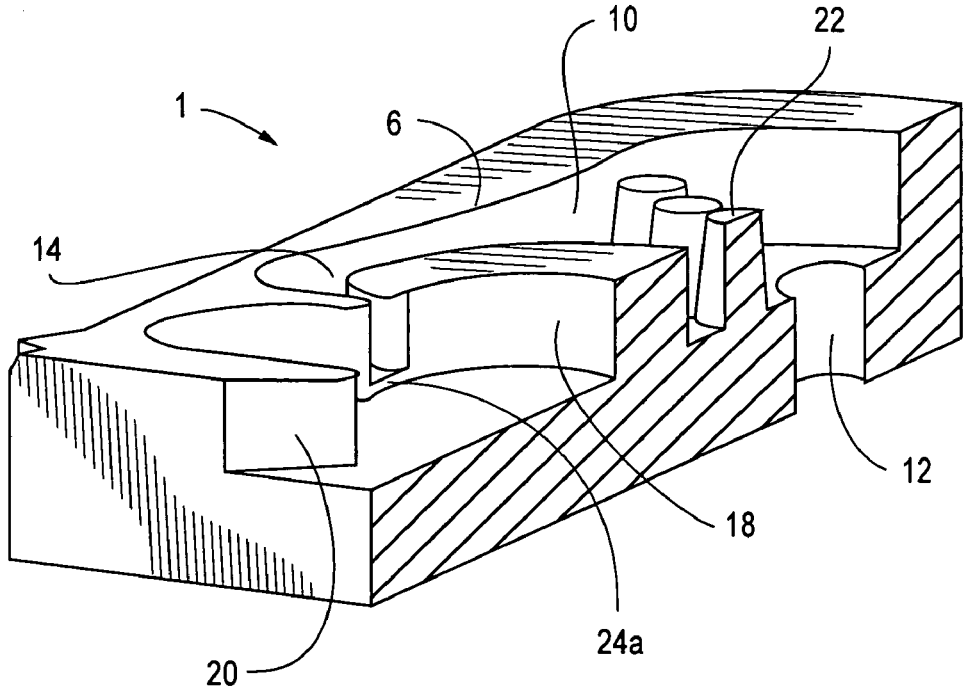
FIG. 8 shows a cross-sectional view of the fluidic insert shown in FIG. 7.
Figure 9:
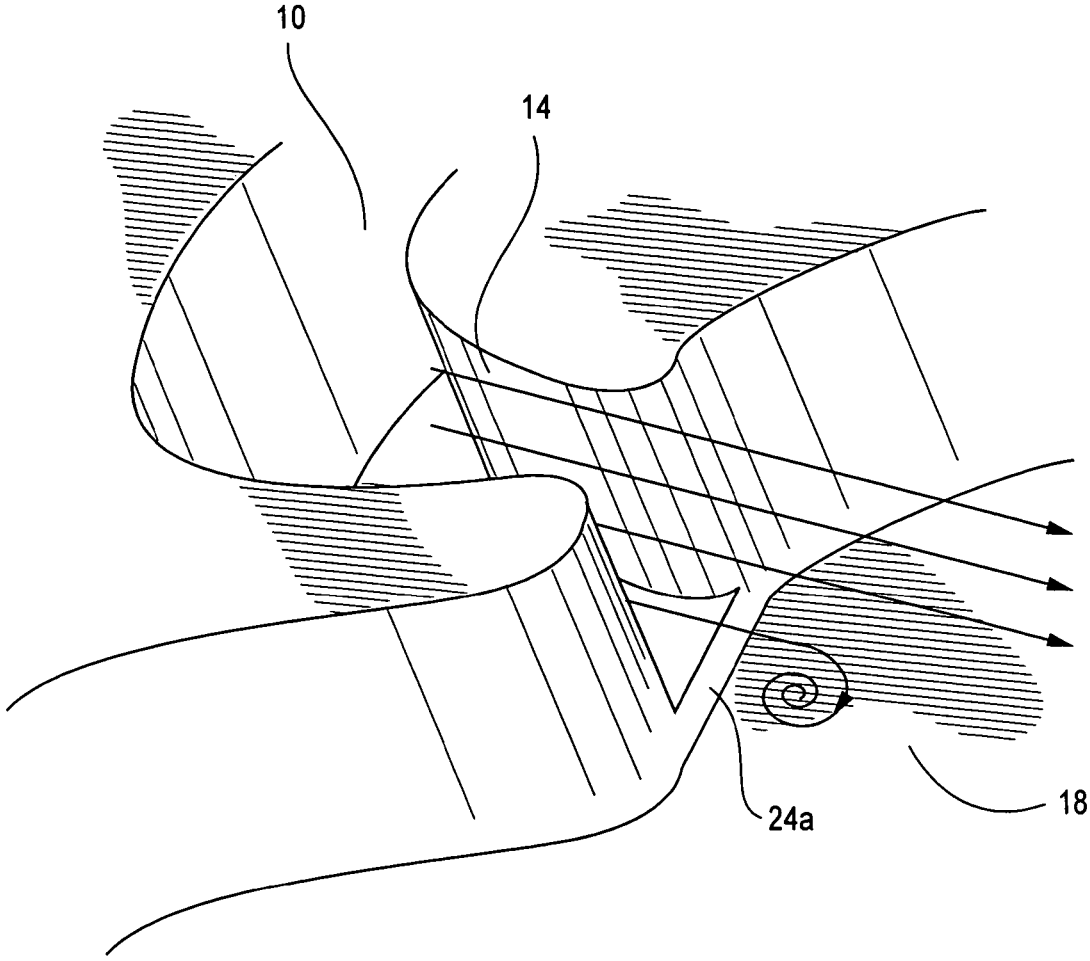
FIG. 9 illustrates the nature of the flow over one of the steps of the fluidic circuit shown in FIG. 7.

This basic "mushroom oscillator" circuit with filter posts is improved upon by the addition of a step 24*a*, 24*b* at each of the exits of the power nozzles. This step 24*a* is better shown in FIG. 8 which is a partial cross-sectional view of the insert 1 shown in FIG. 7. It is seen to be a step or change in the elevation of the floor of the power nozzles with respect to that of the interaction chamber. The flow across one of these steps or step-downs is illustrated by the streamlines shown in FIG. 9.

The effect of the step is to cause a small flow separation region under the jet after it exits the nozzle. The mixing of the relatively higher velocity jet exiting the power nozzle with that of the slower moving fluid that it entrains from below creates the desired instabilities in the jet's flow characteristics. This action is seen to promote the continued oscillatory nature of the flow from such an insert as the temperature of the fluid flowing through it is decreased.

It has been observed that the larger the relative height of the step to that of the power nozzle, the more the oscillating nature of the insert's spray can be preserved as the temperature of the fluid flowing through the insert is decreased. However, it also has been observed that the fan angles of such sprays tend to decrease slightly with such temperature decreases. Hence, it has proven best to identify at a desired colder operating temperature a specific ratio of the step height to the nozzle height so as to yield a sufficiently robust oscillating flow in which there is minimal decrease in the fan angle of the resulting spray.

For a power nozzle of height 0.85-0.92 mm in a fluidic insert that is operating at a pressure of 9-15 psig, a step height of in the range of 0.08-0.16 mm has been experimentally found to yield adequate flow instabilities in the interaction chamber so as to yield, at lower temperatures, a robust oscillating flow with minimal fan angle decreases from such an insert. Step height to power nozzle height ratios in the range of 0.10-0.20 have been found to significantly improve the cold performance of such mushroom oscillators. Optimal performance was achieved with ratios of 0.12-0.15.

Additionally, it was found that the interaction angle of the jets issuing from the power nozzles into the interaction chamber can influence the cold weather performance of such mushroom oscillators. For a relatively wide range of operating pressures, it was found that jet interaction angles in the range of 160 to 190 degrees provided oscillating sprays from such inserts that were the least susceptible to deterioration in their performance when the temperature of the fluid flowing through them was decreased. Optimal performance was achieved at a jet interaction angle of 175 degrees. See FIG. 7.

It should also be noted that the techniques disclosed above, for generating such flow instabilities upstream of the power nozzles of a mushroom oscillator, are also applicable to other types of fluidic circuits.

Figure 10:
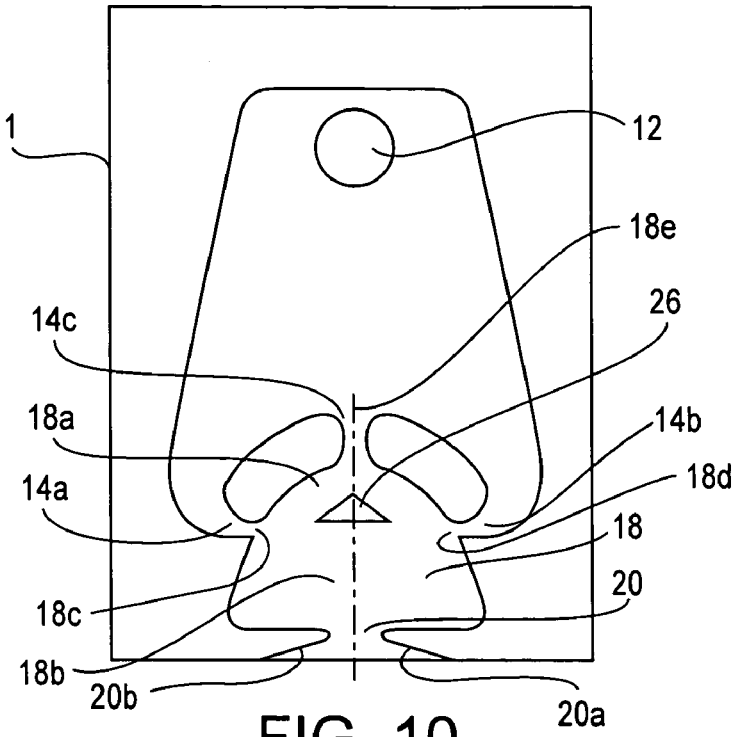
FIG. 10 PRIOR ART
FIG. 10 shows a prior art "three jet island oscillator" having an interaction region into which enter the jets from three power nozzles; with the center jet impacting on an island situated in the interaction chamber.

For example, FIG. 10 shows what is referred to as a "three jet island oscillator." This circuit is composed of three power nozzles 14*a*, 14*b*, 14*c*, an interaction chamber 18 and an island 26 that sits in the interaction chamber 18 and is downstream of the center of the three power nozzles 14. The interaction chamber 18 can be considered to have an upstream 18*a* and a downstream 18*b* portion, with the upstream portion having a pair of boundary edges 18*c*, 18*d* and a longitudinal centerline 18*e* equally spaced from these edges. In a preferred embodiment, one of each of the power nozzles is seen to be located at each of the edges 18*c*, 18*d* of the interaction chamber's upstream portion, and the third power nozzle is located on approximately the centerline 18*e* of the interaction chamber's upstream portion.

Additionally, the chamber's outlet or throat 20 from which a spray exhausts from the chamber's downstream portion 18*b* has right 20*a* and left 20*b* sidewalls that diverge downstream. The island 26 is located directly downstream of the power nozzle that is located on the centerline 18*e* of the interaction chamber.

By appropriately orienting and scaling these elements, one is able to generate flow vortices behind the island that are swept out of the throat in a manner such that the vortices are alternately proximate the throat's right sidewall and then its left sidewall. A triangular shape has been selected as a first preferred embodiment for this island 26, although other shapes (e.g., circular) are possible. This triangular island is oriented so that one of its points faces the oncoming flow from the center power nozzle.

Figure 11:
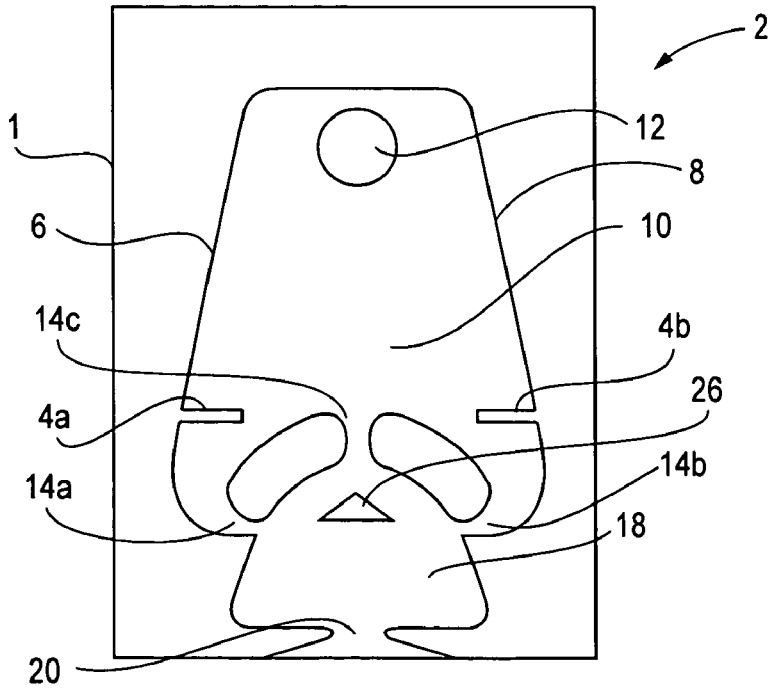
FIG. 11 shows a preferred embodiment of the present invention in the form of an improved "three jet island" fluidic circuit or oscillator for use with higher viscosity fluids.

This three jet island fluidic circuit can be modified to improve its performance as shown in FIG. 11. The improvement for this circuit consists of a protrusion 4*a*, 4*b* that extends inward from each sidewall 6, 8 of the fluid pathway 10 that connects the fluid source inlet 12 and the circuit's perimeter power nozzles 14*a*, 14*b*. These nozzles feed into an interaction chamber 18 from which there is a throat or outlet 20 for the fluid to exhaust from the oscillator 2. Alternatively, a step at each of the perimeter power nozzles has been shown to destabilize the flow through this circuit so as to improve its cold performance capabilities.

Although the foregoing disclosure relates to preferred embodiments of the invention, it is understood that these details have been given for the purposes of clarification only. Various changes and modifications of the invention will be apparent, to one having ordinary skill in the art, without departing from the spirit and scope of the invention as it will eventually be set forth in claims for the present invention.

We claim:

1. A fluidic oscillator that operates on a pressurized fluid flowing through said oscillator to generate an exhaust flow in the form of an oscillating spray of fluid droplets, said oscillator comprising:

an inlet for said pressurized fluid, at least a pair of power nozzles configured to accelerate the movement of said pressurized fluid that flows through said nozzles so as to form a jet of fluid that flows from each said power nozzle, a pathway that connects and allows for the flow of said fluid between said inlet and said power nozzles, said pathway having a boundary surface that includes a pair of sidewalls, an interaction chamber attached to said nozzles and which receives said jet flows from said nozzles, an outlet from which said spray exhausts from said interaction chamber, and a means for increasing the instability of said flow from said power nozzles, said means attached to said pathway at a location upstream of said power nozzles.

2. The fluidic oscillator as recited in claim 1, wherein said flow instability means comprising a pair of protrusions that extend inward from said fluid pathway boundary surface, said protrusions configured so as to cause a flow separation region downstream of said protrusions.

3. The fluidic oscillator as recited in claim 1, wherein said flow instability means comprising a protrusion that extends inward from each said sidewall of said pathway, said protrusions configured so as to cause a flow separation region downstream of said protrusions.

4. The fluidic oscillator as recited in claim 3, wherein said power nozzles being situated with respect to said interaction chamber such that the centerlines from the exits of said power nozzles intersect at an angle in the range of 160 to 190 degrees.

5. The fluidic oscillator as recited in claim 3, wherein said power nozzles being situated with respect to said interaction chamber such that the centerlines from the exits of said power nozzles intersect at an angle of approximately 175 degrees.

6. The fluidic oscillator as recited in claim 3, wherein:

said protrusions having a specified length by which said protrusions extend from said sidewalls and said power nozzles having a specified width at their union with said interaction chamber, and the ratio of said extension length of said protrusions to said width of said power nozzles is in the range of 2-6.

7. The fluidic oscillator as recited in claim 6, wherein said power nozzles being situated with respect to said interaction chamber such that the centerlines from the exits of said power nozzles intersect at an angle in the range of 160 to 190 degrees.

8. The fluidic oscillator as recited in claim 6, wherein said power nozzles being situated with respect to said interaction chamber such that the centerlines from the exits of said power nozzles intersect at an angle of approximately 175 degrees.

9. The fluidic oscillator as recited in claim 1, further comprising:

wherein said interaction chamber having a longitudinal centerline that is approximately equally spaced between said pair of power nozzles, a third power nozzle that is situated proximate said interaction chamber longitudinal centerline and is fed by said pressurized fluid and exhausts into said interaction chamber, an island located in said interaction chamber, and wherein said island being situated downstream of said power nozzle that is located proximate said longitudinal centerline of said interaction chamber.

10. The fluidic oscillator as recited in claim 3, further comprising:

wherein said interaction chamber having a longitudinal centerline that is approximately equally spaced between said pair of power nozzles, a third power nozzle that is situated proximate said interaction chamber longitudinal centerline and is fed by said pressurized fluid and exhausts into said interaction chamber, an island located in said interaction chamber, and wherein said island being situated downstream of said power nozzle that is located proximate said longitudinal centerline of said interaction chamber.

11. A method of forming an oscillating spray of fluid droplets, said method comprising the steps of:

causing a pressurized fluid to flow into an inlet, placing at least a pair of power nozzles downstream from said inlet and configuring said nozzles to accelerate the movement of said pressurized fluid when said fluid flows through said nozzles so as to form a jet of fluid that flows from each said power nozzle, using a fluid pathway to connect and allow for the flow of said fluid between said fluid inlet and said power nozzles, said pathway having a boundary surface that includes a pair of sidewalls, attaching an interaction chamber downstream from said nozzles and configuring said chamber to receive said jet flows from said nozzles, providing said chamber with a fluid outlet from which said spray exhausts from said interaction chamber, and using a means for increasing the instability of said flow from said power nozzles, said means attached to said pathway at a location upstream of said power nozzles.

12. The method as recited in claim 11, wherein said flow instability means comprising a pair of protrusions that extend inward from said fluid pathway boundary surface, said protrusions configured so as to cause a flow separation region downstream of said protrusions.

13. The method as recited in claim 11, wherein said flow instability means comprising a protrusion that extends inward from each said sidewall of said pathway, said protrusions configured so as to cause a flow separation region downstream of said protrusions.

14. The method as recited in claim 13, wherein said power nozzles being situated with respect to said interaction chamber such that the centerlines from the exits of said power nozzles intersect at an angle in the range of 160 to 190 degrees.

15. The method as recited in claim 13, wherein said power nozzles being situated with respect to said interaction chamber such that the centerlines from the exits of said power nozzles intersect at an angle of approximately 175 degrees.

16. The method fluidic as recited in claim 13, wherein:

said protrusions having a specified length by which said protrusions extend from said sidewalls and said power nozzles having a specified width at their union with said interaction chamber, and the ratio of said extension length of said protrusions to said width of said power nozzles is in the range of 2-6.

17. The method as recited in claim 16, wherein said power nozzles being situated with respect to said interaction chamber such that the centerlines from the exits of said power nozzles intersect at an angle in the range of 160 to 190 degrees.

18. The method as recited in claim 16, wherein said power nozzles being situated with respect to said interaction chamber such that the centerlines from the exits of said power nozzles intersect at an angle of approximately 175 degrees.

19. The method as recited in claim 11, further comprising:

wherein said interaction chamber having a longitudinal centerline that is approximately equally spaced between said pair of power nozzles, a third power nozzle that is situated proximate said interaction chamber longitudinal centerline and is fed by said pressurized fluid and exhausts into said interaction chamber, an island located in said interaction chamber, and wherein said island being situated downstream of said power nozzle that is located proximate said longitudinal centerline of said interaction chamber.

20. The method as recited in claim 13, further comprising:

wherein said interaction chamber having a longitudinal centerline that is approximately equally spaced between said pair of power nozzles, a third power nozzle that is situated proximate said interaction chamber longitudinal centerline and is fed by said pressurized fluid and exhausts into said interaction chamber, an island located in said interaction chamber, and wherein said island being situated downstream of said power nozzle that is located proximate said longitudinal centerline of said interaction chamber.

21. A fluid spray apparatus comprising:

a fluidic insert that operates on pressurized fluid flowing through said insert to generate an exhaust flow in the form of an oscillating spray of fluid droplets, said insert having a fluidic circuit molded into said insert, said fluidic circuit having:

an inlet for said pressurized fluid, at least a pair of power nozzles configured to accelerate the movement of said pressurized fluid that flow through said nozzles so as to form a jet of fluid that flows from each said power nozzle, a pathway that connects and allows for the flow of said fluid between said inlet and said power nozzles, said pathway having a boundary surface that includes a pair of sidewalls, an interaction chamber attached to said nozzles and which receives said jet flows from said nozzles, an outlet from which said spray exhausts from said interaction chamber, and a means for increasing the instability of said flow from said power nozzles, said means attached to said pathway at a location upstream of said power nozzles.

22. The fluid spray apparatus as recited in claim 21, wherein said flow instability means comprising a pair of protrusions that extend inward from said fluid pathway boundary surface, said protrusions configured so as to cause a flow separation region downstream of said protrusions.

23. The fluid spray apparatus as recited in claim 21, wherein said flow instability means comprising a protrusion that extends inward from each said sidewall of said pathway, said protrusions configured so as to cause a flow separation region downstream of said protrusions.

24. The fluid spray apparatus as recited in claim 23, wherein said power nozzles being situated with respect to said interaction chamber such that the centerlines from the exits of said power nozzles intersect at an angle in the range of 160 to 190 degrees.

25. The fluid spray apparatus as recited in claim 23, wherein said power nozzles being situated with respect to said interaction chamber such that the centerlines from the exits of said power nozzles intersect at an angle of approximately 175 degrees.

26. The fluid spray apparatus as recited in claim 23, wherein:

said protrusions having a specified length by which said protrusions extend from said sidewalls and said power nozzles having a specified width at their union with said interaction chamber, and the ratio of said extension length of said protrusions to said width of said power nozzles is in the range of 2-6.

27. The fluid spray apparatus as recited in claim 26, wherein said power nozzles being situated with respect to said interaction chamber such that the centerlines from the exits of said power nozzles intersect at an angle in the range of 160 to 190 degrees.

28. The fluid spray apparatus as recited in claim 26, wherein said power nozzles being situated with respect to said interaction chamber such that the centerlines from the exits of said power nozzles intersect at an angle of approximately 175 degrees.

29. The fluid spray apparatus as recited in claim 21, further comprising:

wherein said interaction chamber having a longitudinal centerline that is approximately equally spaced between said pair of power nozzles, a third power nozzle that is situated proximate said interaction chamber longitudinal centerline and is fed by said pressurized fluid and exhausts into said interaction chamber, an island located in said interaction chamber, and wherein said island being situated downstream of said power nozzle that is located proximate said longitudinal centerline of said interaction chamber.

30. The fluid spray apparatus as recited in claim 23, further comprising:

wherein said interaction chamber having a longitudinal centerline that is approximately equally spaced between said pair of power nozzles, a third power nozzle that is situated proximate said interaction chamber longitudinal centerline and is fed by said pressurized fluid and exhausts into said interaction chamber, an island located in said interaction chamber, and wherein said island being situated downstream of said power nozzle that is located proximate said longitudinal centerline of said interaction chamber.

* * * * *